US009122227B2

(12) United States Patent
Mori

(10) Patent No.: US 9,122,227 B2
(45) Date of Patent: Sep. 1, 2015

(54) IMAGE FORMING APPARATUS

(71) Applicant: Shogo Mori, Nagoya (JP)

(72) Inventor: Shogo Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 106 days.

(21) Appl. No.: 13/784,879

(22) Filed: Mar. 5, 2013

(65) Prior Publication Data

US 2013/0259515 A1 Oct. 3, 2013

(30) Foreign Application Priority Data

Mar. 29, 2012 (JP) ..... 2012-076083

(51) Int. Cl.
*G03G 15/00* (2006.01)
*G03G 21/16* (2006.01)

(52) U.S. Cl.
CPC ..... *G03G 21/16* (2013.01); *G03G 21/1633* (2013.01)

(58) Field of Classification Search
CPC ..... G03G 21/16; G03G 21/1619; G03G 21/1633; G03G 21/1647
USPC ..... 399/107, 110
See application file for complete search history.

(56) References Cited

U.S. PATENT DOCUMENTS

| | | | | |
|---|---|---|---|---|
| 8,126,356 | B2 | 2/2012 | Watanabe et al. | |
| 2008/0166145 | A1* | 7/2008 | Watanabe et al. | 399/30 |
| 2008/0170887 | A1* | 7/2008 | Nishimura et al. | 399/262 |
| 2009/0169249 | A1 | 7/2009 | Watanabe et al. | |
| 2013/0259517 | A1 | 10/2013 | Mori | |

FOREIGN PATENT DOCUMENTS

| | | | |
|---|---|---|---|
| CN | 101221384 | A | 7/2008 |
| CN | 101226362 | A | 7/2008 |
| JP | 2009-157137 | A | 7/2009 |

OTHER PUBLICATIONS

Mar. 12, 2015—(CN) The First Office Action—App 201310096322.6, Eng Tran.

* cited by examiner

*Primary Examiner* — David Bolduc
*Assistant Examiner* — Barnabas Fekete
(74) *Attorney, Agent, or Firm* — Banner & Witcoff, Ltd.

(57) ABSTRACT

An image forming apparatus includes: a body frame having an opening, a cartridge being configured to be removably mounted to the body frame through the opening; and a cover configured to open and close the opening, wherein the cover includes a metallic reinforcement plate that is configured to face the cartridge mounted to the body frame when the cover is closed, and wherein the reinforcement plate includes a first recess part configured to receive therein a part of the cartridge mounted to the body frame when the cover is closed.

20 Claims, 7 Drawing Sheets

IMAGE FORMING APPARATUS

CROSS-REFERENCE TO RELATED APPLICATIONS

This application claims priority from Japanese Patent Application No. 2012-076083 filed on Mar. 29, 2012, the entire subject matter of which is incorporated herein by reference.

TECHNICAL FIELD

The invention relates to an image forming apparatus having a cover that is configured to open and close an opening of a body frame.

BACKGROUND

There have been proposed an image forming apparatus which has a body frame having an opening, through which a cartridge can be replaced, and a cover for opening and closing the opening. The related-art image forming apparatus is provided with a metallic shield plate (reinforcement plate) in the cover so as to improve strength of the cover.

SUMMARY

The cover of the image forming apparatus is opened and closed whenever the cartridge is replaced, so that it is necessary to increase the rigidity thereof. For the image forming apparatus having the above-described configuration, it may be considered that the reinforcement plate is subject to a bending process, a drawing process and the like to thus form unevenness. According thereto, it may be possible to improve the rigidity of the reinforcement plate and to improve the rigidity of the cover reinforced by the reinforcement plate. However, since the reinforcement plate is formed with the unevenness, the reinforcement plate is thus enlarged in a thickness direction, and a size of the image forming apparatus may be enlarged.

Therefore, illustrative aspects of the invention provide an image forming apparatus that is suppressed from being enlarged while improving rigidity of a cover.

According to one illustrative aspect of the invention, there is provided an image forming apparatus comprising: a body frame having an opening, a cartridge being configured to be removably mounted to the body frame through the opening: and a cover configured to open and close the opening. The cover comprises a metallic reinforcement plate that is configured to face the cartridge mounted to the body frame when the cover is closed. The reinforcement plate comprises a first recess part configured to receive therein a part of the cartridge mounted to the body frame when the cover is closed.

In other words, an image forming apparatus comprises: a body frame having an opening, a cartridge being configured to be removably mounted to the body frame through the opening; and a cover that is configured to rotate between a close position, at which the opening is covered, and an open position, at which the opening is exposed, around a rotation axis, the cover comprising a reinforcement plate that is configured to face the cartridge mounted to the body frame when the cover is located at the close position. The reinforcement plate comprises: a pair of body parts; a pair of bent parts that is bent from inner end portions of the pair of body parts in an axial direction of the rotation axis toward a side opposite to the cartridge; and a connection part connecting the pair of bent parts. A part of the cartridge is configured to be arranged at a side of the connection part from a line, which connects the inner end portions of the pair of body parts, when the cartridge is mounted to the body frame and the cover is located at the close position.

According to this configuration, the reinforcement plate includes the first recess part (the pair of bent parts and the connection part), so that the reinforcement plate has an unevenness shape as a whole. Therefore, it is possible to improve the rigidity of the reinforcement plate and the cover that is reinforced by the reinforcement plate. In the configuration where the reinforcement plate has the unevenness, a part of the cartridge enters the first recess part (a part of the cartridge is arranged at the connection part-side than the line connecting the inner end portions of the pair of body parts when the cover is closed). Hence, it is possible to suppress the image forming apparatus from being enlarged, compared to a configuration where the part of the cartridge faces a part (the pair of the body parts) other than the first recess part of the reinforcement plate.

According to another illustrative aspect of the invention, the image forming apparatus further comprises a plurality of the cartridges. The first recess part is formed as one recess part configured to receive therein parts of the respective cartridges mounted to the body frame when the cover is closed.

In other words, the image forming apparatus further comprises a plurality of the cartridges. A part of each cartridge is configured to be arranged at the side of the connection part from the line when the cartridges are mounted to the body frame and the cover is located at the close position.

According to this configuration, while securing the rigidity of the reinforcement plate (cover), it is possible to simplify the configuration of the reinforcement plate, compared to a configuration where a plurality of first recess parts into which the parts of the respective cartridges are individually introduced is provided.

According to still another illustrative aspect of the invention, the part of the cartridge is a grip configured to be grasped when mounting and removing the cartridge to and from the body frame.

According to this configuration, it is possible to improve the operability when mounting and removing the cartridge. Incidentally, if a part of the cartridge having a function, such as a grip, is omitted, it may cause a problem, regarding the operability and the like. However, the first recess part into which the part (grip and the like) of the cartridge can be introduced is provided to the reinforcement plate, so that it is possible to suppress the image forming apparatus from being enlarged due to the part of the cartridge.

According to still another illustrative aspect of the invention, the reinforcement plate comprises: a through-hole that is formed at a position different from the first recess part; and a second recess part that is separately formed from the first recess part in a vicinity of the through-hole.

According to this configuration, in the configuration where the reinforcement plate includes the through-hole, the second recess part is separately formed from the first recess part in the vicinity of the through-hole. Thereby, it is possible to improve the rigidity of the reinforcement plate (cover), compared to a configuration where the second recess part is not provided. Incidentally, the through-hole may be used to enable a wiring to pass therethrough or the air to be introduced therethrough.

According to still another illustrative aspect of the invention, the image forming apparatus further comprises: a charger configured to charge a photosensitive member by a corona discharge; and a seal member configured to be disposed between the reinforcement plate and the cartridge when the cover is closed so as to brought into contact with both the reinforcement plate and the cartridge.

In other words, the image forming apparatus further comprises: a charger configured to charge a photosensitive member by a corona discharge; and an elastic member configured to be disposed in a gap between the reinforcement plate and the cartridge when the cover is located at the close position.

According to this configuration, the seal member (elastic member) can form at least a part of a wall of a flow passage of the air having passed through the charger or the air flowing toward the charger. Specifically, when a plurality of the cartridges is arranged side by side, the seal member can partition the flow passage of the air having passed through the respective chargers or the air flowing toward the respective chargers.

According to still another illustrative aspect of the invention, the reinforcement plate comprises a third recess part that extends from an end portion of the first recess part.

In other words, the reinforcement plate comprises a pair of second bent parts, which is provided at outer sides in a facing direction of the pair of bent parts, and which is bent from the pair of body parts. The pair of second bent parts is connected by the connection part.

According to this configuration, it is possible to further improve the rigidity of the reinforcement plate (cover).

According to still another illustrative aspect of the invention, the cover comprises: a resin cover body configured to cover the reinforcement plate; and an engaging member that is separately formed from the cover body and is configured to be engaged with the body frame when the cover is closed. The engaging member is fixed to the cover body via the reinforcement plate.

In other words, the cover comprises: a resin cover body configured to cover the reinforcement plate; and an engaging member that is configured to be engaged with the body frame when the cover is located at the close position. The engaging member is fixed to the cover body via the reinforcement plate by a screw.

According to this configuration, it is possible to improve the attaching rigidity of the engaging member, compared to a configuration where the engaging member is directly fixed to the cover body. Further, since it is possible to fix (at least a part of) the reinforcement plate to the cover body at the same time by fixing the engaging member, it is possible to reduce the number of the screws and the like, compared to a configuration where the engaging member and the reinforcement plate are individually fixed to the cover body. Therefore, it is possible to reduce the number of parts of the image forming apparatus and the assembling man-hour. Further, since it is possible to reduce the number of the screws for fixing, the number of screw holes and the like, it is possible to make the reinforcement plate or cover body smaller. As a result, it is possible to make the image forming apparatus smaller.

According to still another illustrative aspect of the invention, the cover is provided to the body frame so as to be rotatable around a rotation axis, the rotation axis being provided to a side of a first end portion of the cover body. The engaging member comprises a first engaging member and a second engaging member, which are provided at a second end portion that is opposite to the first end portion of the cover body, and which are arranged side by side in an axial direction of the rotation axis. The body frame comprises: a first lock member configured to move in the axial direction and is configured to be engaged with the first engaging member when the cover is closed; a second lock member configured to move in the axial direction and is configured to be engaged with the second engaging member when the cover is closed; a first urging member configured to urge the first lock member toward one side of the axial direction: and a second urging member configured to urge the second lock member toward the same direction as the first urging member.

In other words, the rotation axis is provided to a side of a first end portion of the cover body. The engaging member comprises a first engaging member and a second engaging member that are provided at a second end portion that is opposite to the first end portion of the cover body and are arranged side by side in the axial direction of the rotation axis. The body frame comprises: a first lock member configured to move in the axial direction and is configured to be engaged with the first engaging member when the cover is located at the close position; a second lock member configured to move in the axial direction and is configured to be engaged with the second engaging member when the cover is located at the close position; a first urging member configured to urge the first lock member toward one side of the axial direction; and a second urging member configured to urge the second lock member toward the same direction as the first urging member.

According to this configuration, since it is possible to adopt the same configuration at the first engaging member-side and the second engaging member-side, it is possible to share parts of the first lock member and the second lock member and parts of the first urging member and the second urging member, for example. According thereto, the cost of the image forming apparatus can be reduced.

According to still another illustrative aspect of the invention, the body frame comprises: a first abutting part having a surface shape and provided across the first engaging member from the first lock member, the first engaging member being configured to abut on the first abutting part when the cover is closed; and a second abutting part having a surface shape and provided across the second engagement member from the second lock member, the second engaging member being configured to abut on the second abutting part when the cover is closed.

In other words, the body frame comprises: a first abutting surface that is provided across the first engaging member from the first lock member and is configured to abut on the first engaging member when the cover is located at the close position; and a second abutting surface that is provided across the second engagement member from the second lock member and is configured to abut on the second engaging member when the cover is located at the close position.

According to this configuration, when the cover is closed, it is possible to stably support the respective engaging members on the surfaces. Thereby, it is possible to suppress the bending of the first engaging member, which is pushed by the first lock member, or the bending of the second engaging member, which is pushed by the second lock member, for example. According thereto, it is possible to suppress the respective engaging members from being separated from the corresponding lock members.

According to still another illustrative aspect of the invention, the cover comprises an exposure unit having a plurality of blinking parts and is configured to expose a photosensitive member.

According to the invention, the reinforcement plate includes the first recess part (the pair of bent parts and the connection part) into which a part of the cartridge mounted to the body frame is introduced when the cover is closed. Therefore, it is possible to suppress the image forming apparatus from being enlarged while improving the rigidity of the cover.

DETAILED DESCRIPTION

Hereinafter, exemplary embodiments of the invention will be described with reference to the accompanying drawings. Incidentally, in the below descriptions, a schematic configuration of a color printer 1, which is an example of the image forming apparatus, will be briefly described and then configurations of a top cover 200 and a body frame 100 will be described. Further, in the below descriptions, the directions are described on the basis of a user who uses the color printer 1. That is, the left of FIG. 1 is referred to as the 'front,' the right of FIG. 1 is referred to as the 'rear,' the front side of FIG. 1 is referred to as the 'right' and the inner side of FIG. 1 is referred to as the 'left.' Further, the upper and lower directions of FIG. 1 are referred to as the 'upper-lower.'

<Schematic Configuration of Color Printer>

Figure 1:
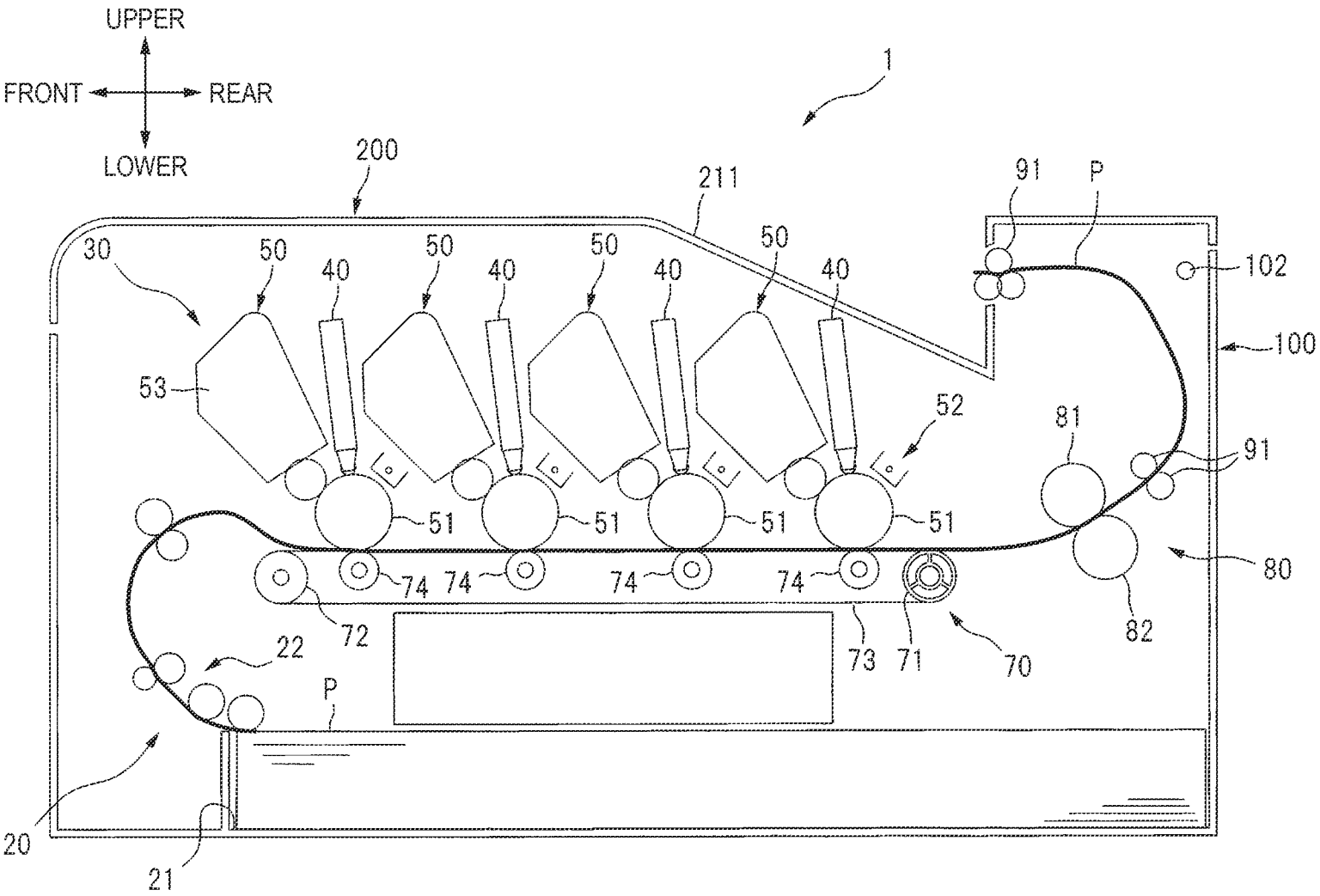
FIG. 1 shows a schematic configuration of a color printer that is one example of the image forming apparatus according to an exemplary embodiment of the invention.

As shown in FIG. 1, the color printer 1 includes a body frame 100, a top cover 200 that is an example of the cover and a feeder unit 20 and an image forming unit 30 that are provided in the body frame 100.

Figure 2:
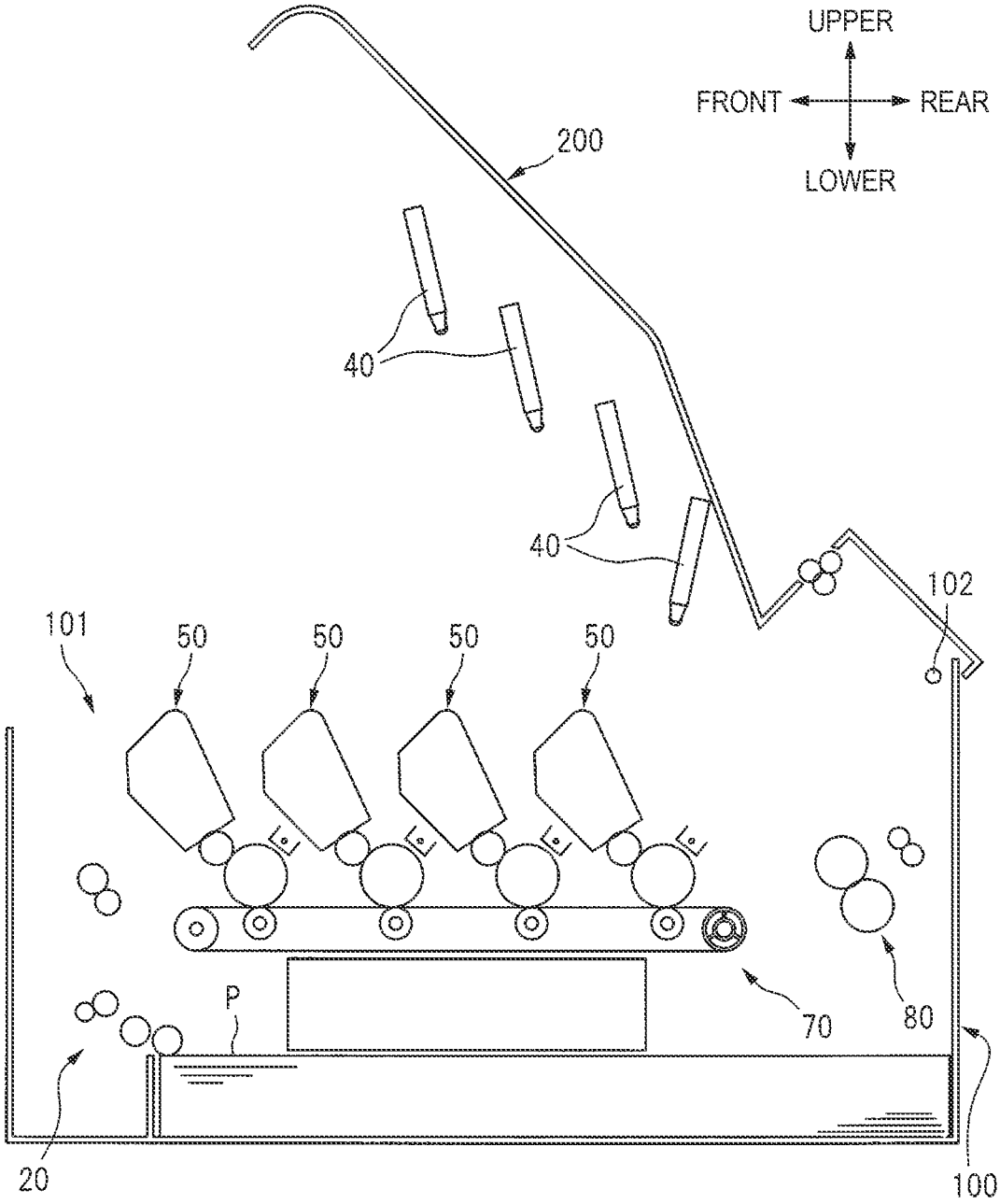
FIG. 2 shows the color printer at a state where a top cover is opened.

The top cover 200 is a cover configured to open and close an opening 101 (refer to FIG. 2) that is provided at the upper of the body frame 100. The top cover 200 is arranged at the upper of the body frame 100. The top cover 200 is provided to rotate relative to the body frame 100 about a rotation axis 102 provided to a rear side of the body frame 100. More specifically, the top cover 200 is configured to rotate between a close position at which the opening 101 is covered (closed) (refer to FIG. 1) and an open position at which the opening 101 is exposed.

Back to FIG. 1, the feeder unit 20 is provided at the lower in the body frame 100. The feeder unit 20 includes a sheet feeding tray 21 configured to accommodate a sheet P and a sheet feeding mechanism 22 configured to feed the sheet P from the sheet feeding tray 21 to the image forming unit 30. The sheets P in the sheet feeding tray 21 are separated and fed one at a time to the image forming unit 30 by the sheet feeding mechanism 22.

The image forming unit 40 includes LED units 40, which are an example of the exposure unit, process cartridges 50 that are an example of the cartridge, a transfer unit 70 and a fixing unit 80.

Figure 3:
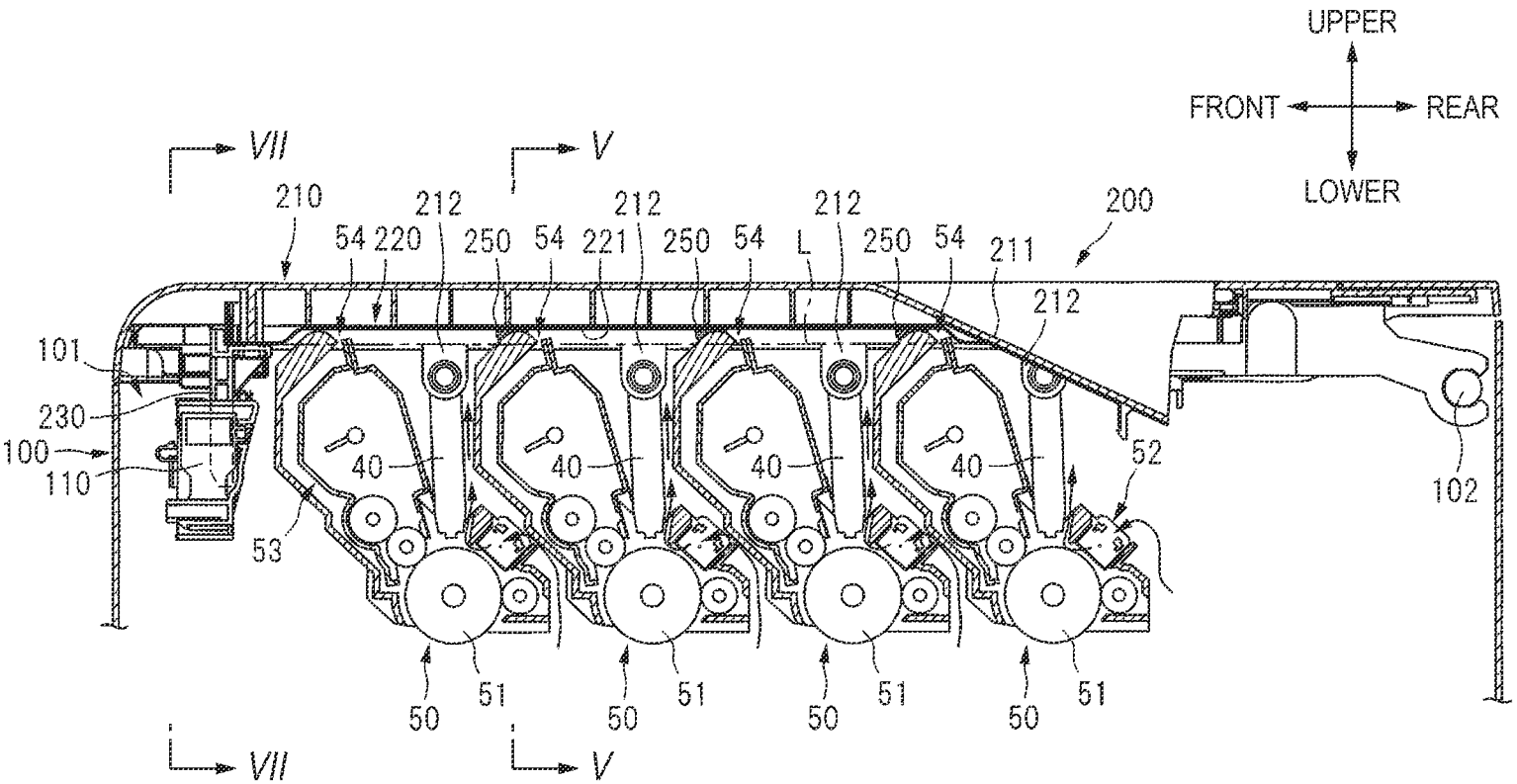
FIG. 3 is an enlarged sectional view showing a detailed configuration around the top cover.

The four LED units 40 are swingably supported to the top cover 200 via holders 212 (refer to FIG. 3). A tip (lower end of FIG. 1) of the LED unit 40 is provided with a plurality of LEDs that is an example of a plurality of blinking parts and is arranged to face the upper of a photosensitive drum 51 when the top cover 200 is closed (located at the close position). The LED unit 40 is configured to expose a surface of the photosensitive drum 51 as the LEDs are selectively blinked based on image data. Further, the LED unit 40 is configured to be spaced from the photosensitive drum 51 when the top cover 200 is opened (located at the open position) (refer to FIG. 2).

The four process cartridges 50 are arranged in the front-rear direction between the top cover 200 and the sheet feeding tray 21. Each process cartridge 50 is removably mounted through the opening 101 of the body frame 100 at a state where the top cover 200 is opened (refer to FIG. 2). Further, each process cartridge 50 includes the photosensitive drum 51, which is an example of the photosensitive member, a charger 52 configured to charge the photosensitive drum 51 by a corona discharge and a developing device 53 configured to supply toner accommodated therein to the photosensitive drum 51.

The transfer unit 70 is provided between the sheet feeding tray 21 and the process cartridges 50. The transfer unit 70 includes a driving roller 71, a driven roller 72, an endless conveyance belt 73 that is provided in a tensioned state between the driving roller 71 and the driven roller 72 and four transfer rollers 74. The conveyance belt 73 has an outer surface that abuts on the respective photosensitive drums 61, and the respective transfer rollers 74 are arranged to sandwich the conveyance belt 73 at an inside of the conveyance belt 73 between the transfer rollers 74 and the photosensitive drums 61.

The fixing unit 80 is provided at the rear of the process cartridges 50 and the transfer unit 7. The fixing unit 80 includes a heating roller 81 and a pressing roller 82 that is arranged to face the heating roller 81 and is configured to presses the heating roller 81.

In the image forming unit 30, the surfaces of the photosensitive drums 51 are uniformly charged by the corona discharges of the chargers 52 and are then exposed by the LED units 40, so that electrostatic latent images based on image data are formed on the photosensitive drums 51. Then, the toner is supplied from the developing devices 53 to the photosensitive drums 51, so that the electrostatic latent images become visible and toner images are thus formed on the photosensitive drums 51.

As the sheet P that is fed from the feeder unit 20 is conveyed between the photosensitive drums 51 and the conveyance belt 73 (transfer rollers 74), the toner images formed on the respective photosensitive drums 51 are sequentially transferred with being overlapped onto the sheet P. The sheet P having the toner images transferred thereto is conveyed between the heating roller 81 and the pressing roller 82, so that the toner images are heat-fixed. After that, the sheet P is discharged to the outside from the body frame 100 by conveyance rollers 91 and is put on a sheet discharge tray 211.

<Configurations of Top Cover and Body Frame>

As shown in FIG. 3, the top cover 200 includes a resin cover body 210, a metallic reinforcement plate 220 and a first engaging member 230 and a second engaging member 240 (refer to FIGS. 6 and 7) serving as the engaging member.

The cover body 210 has a substantial U shape (refer to FIG. 5), when seen from a section. The reinforcement plate 220 is fixed to the inside of the cover body 210. An upper surface of the cover body 210 is formed with the sheet discharge tray 211. Further, the cover body 210 is provided with four pairs of holders 212 configured to support the LED units 40, which are arranged side by side, in the front-rear direction.

Figure 4:
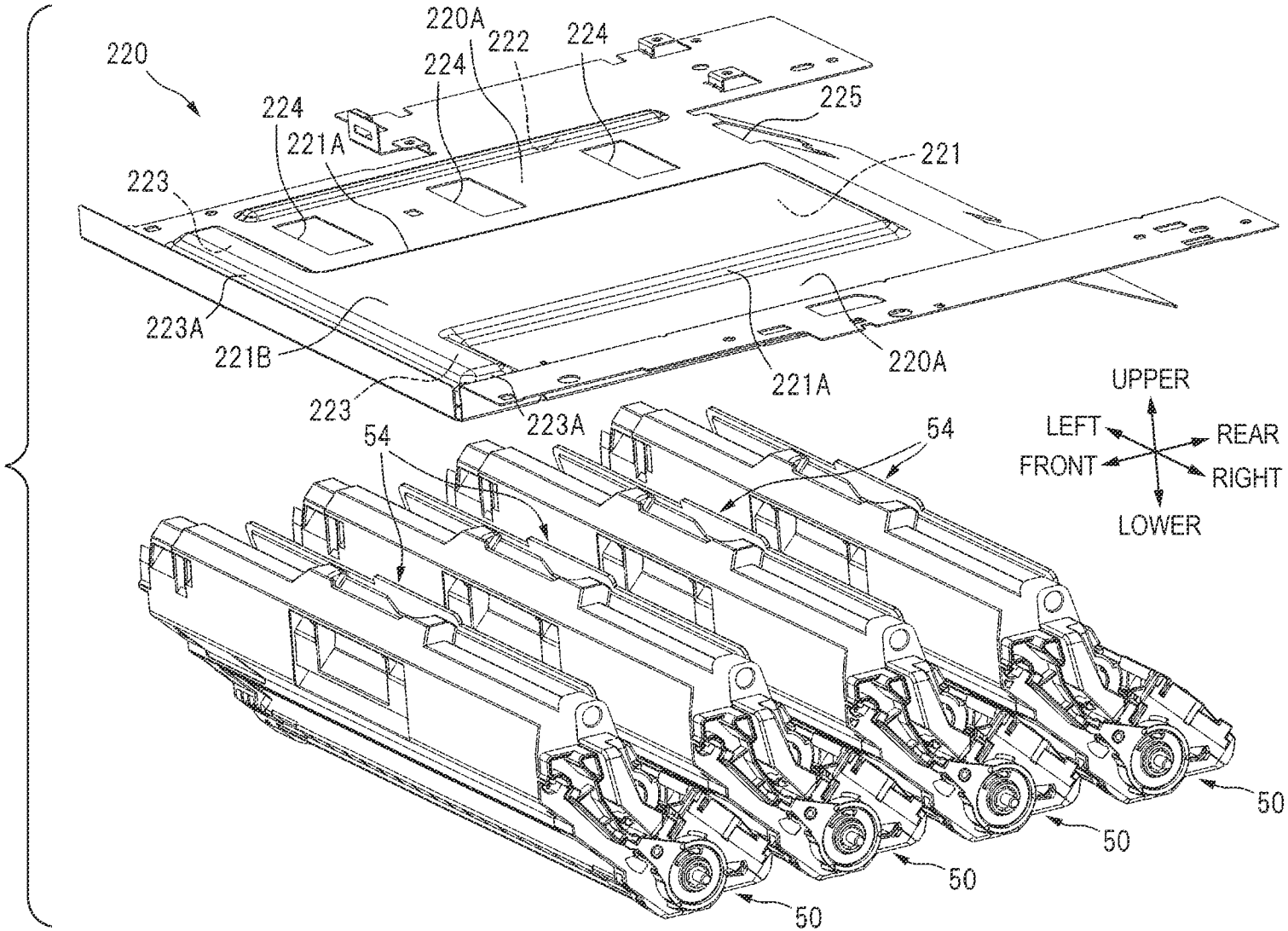
FIG. 4 is a perspective view of a reinforcement plate and a process cartridge.

The reinforcement plate 220 is formed by pressing a plate, for example, and is arranged so that it is covered with the cover body 210. The reinforcement plate 220 is exposed to the outside as a part of an inner surface of the top cover 200 when the top cover 200 is located at the open position (refer to FIG. 6B) and faces the respective process cartridges 50 provided to the body frame 100 when the top cover 200 is located at the close position (refer to FIG. 3). As shown in FIG. 4, the reinforcement plate 220 includes a first recess part 221, a second recess part 222, third recess parts 223 and through-holes 224.

Figure 5:
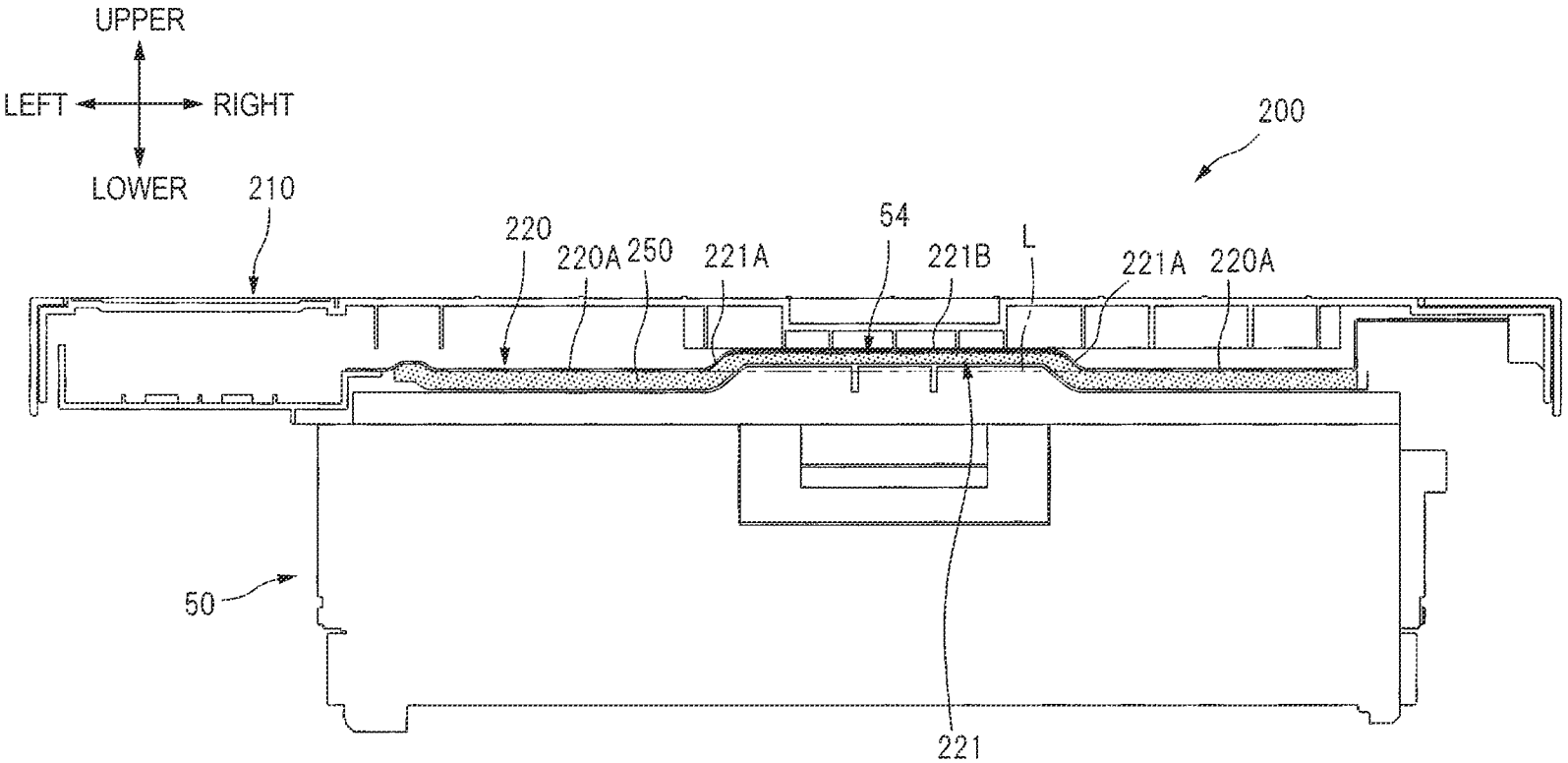
FIG. 5 is a sectional view taken along a line V-V of FIG. 3.

The first recess part 221 is one recess part that is formed to be long in the front-rear direction at the upper of a central part of each process cartridge 50 in the left-right direction and has a shape recessed from the lower toward the upper. In other words, as shown in FIG. 5, the first recess part 221 includes a pair of bent portions 221A and a connection portion 221B. The pair of bent portions 221A is bent from inner end portions of a pair of left and right body portions 220A of the reinforcement plate 220, which is provided at an interval at the left and right sides, in the left-right direction (rotating axis line direction of the top cover 200) toward an inner oblique upper side (an opposite side to the process cartridges 50) in the left-right direction. The connection portion 221B connects the pair of bent portions 221A.

A part of each process cartridge 50 mounted to the body frame 100, specifically a grip 54 that is grasped when mounting and removing each process cartridge 50 to and from the body frame 10, enters the first recess part 221 when the top cover 200 is located at the close position (refer to FIG. 3). In other words, when the process cartridges 50 are mounted to the body frame 100 and the top cover 200 is located at the close position, the respective grips 54 (the parts of the respective process cartridges 50) are arranged at the connection portion 221B-side (upper side) than a line L connecting the inner end portions of the pair of body portions 220A.

As shown in FIG. 4, the three through-holes 224 are formed side by side at position different from the first recess part 221, specifically at the left of the first recess part 221. A harness (not shown) connecting each of the three LED units 40, which are arranged lopsidedly toward the front, and a control substrate (not shown) arranged at the upper of the reinforcement plate 220 passes through the through-holes 224. Incidentally, a through-hole 225 is formed at the rear of the through-holes 224. A harness connecting the LED unit 40, which is arranged at the most rearward side, and the control substrate passes though the through-hole 225.

The second recess part 222 is a recess part that is separately formed from the first recess part 221 in the vicinity of the through-holes 224. The second recess part 222 has a shape recessed from the lower toward the upper. More specifically, the second recess part 222 is formed to be long in the front-rear direction so that the three through-holes 224 are positioned between the second recess part and the first recess part 221.

The third recess parts 223 are a pair of recess parts that protrudes from an end portion of the first recess part 221, specifically, front end portions of left and right sidewalls (bent portions 221A) forming the first recess part 221 toward outer sides in the left-right direction. The third recess parts have a shape recessed from the lower toward the upper. The third recess parts 223 are integrally formed with the first recess part 221 and form a substantial T shape together with the first recess part 221, when seen from a plan view. In other words, the third recess parts 223 include a pair of second bent portions 223A having a substantial U shape that is provided at the outer sides in the facing direction of the pair of bent portions 221A (at the outer sides in the left-right direction) and is bent obliquely upwards from the pair of body portions 220A, and are formed as the pair of second bent portions 223A is connected by a connection portion 221B.

As shown in FIGS. 3 and 5, seal members 250 having elasticity are respectively arranged in a gap between the reinforcement plate 220 and the three process cartridges 50 arranged lopsidedly toward the rear. The seal member 250 is a foamed elastic member (elastic member) having a plate shape long in the left-right direction, such as urethane foam. The seal member 250 is adhered along a lower surface (the pair of body portions 220A, the pair of bent portions 221A and the connection portion 221B) of the reinforcement plate 220. When the top cover 200 is closed, the seal members 250 are contacted with being slightly squashed to both the reinforcement plate 220 and the process cartridges 50. Incidentally, the seal member 250 is not provided between the reinforcement plate 220 and the process cartridge 50 that is arranged at the most forward side.

Figure 6A:
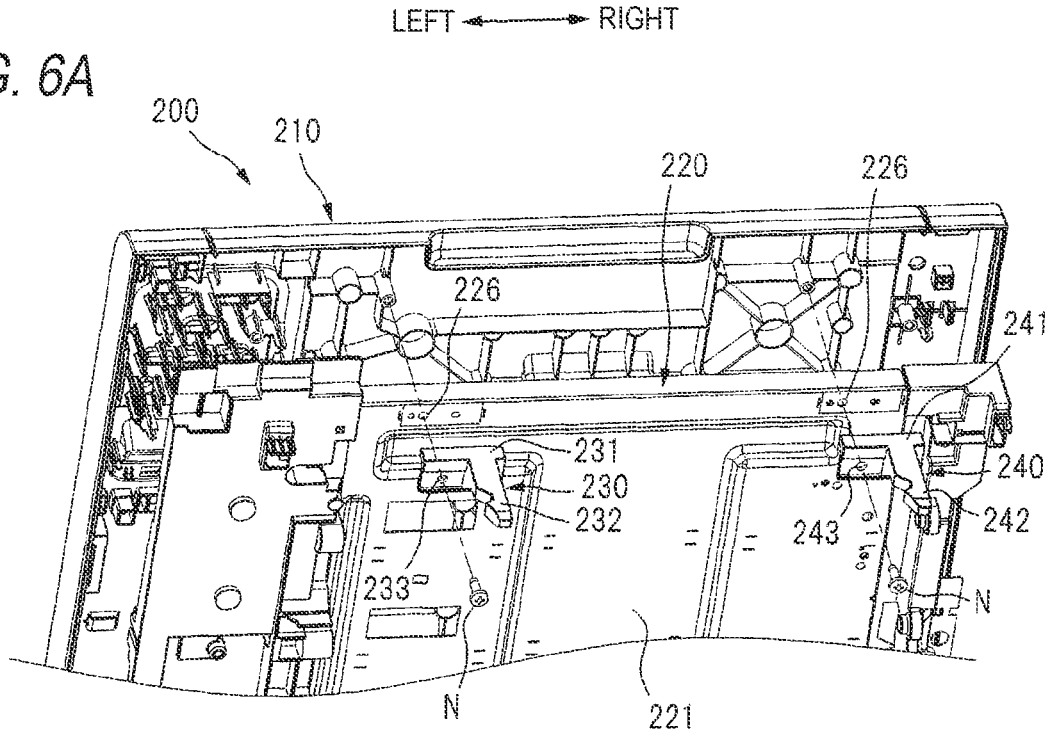
FIG. 6A shows an exploded perspective view of the top cover and FIG. 6B shows an enlarged perspective view of the top cover, which are seen from an inside.
Figure 6B:
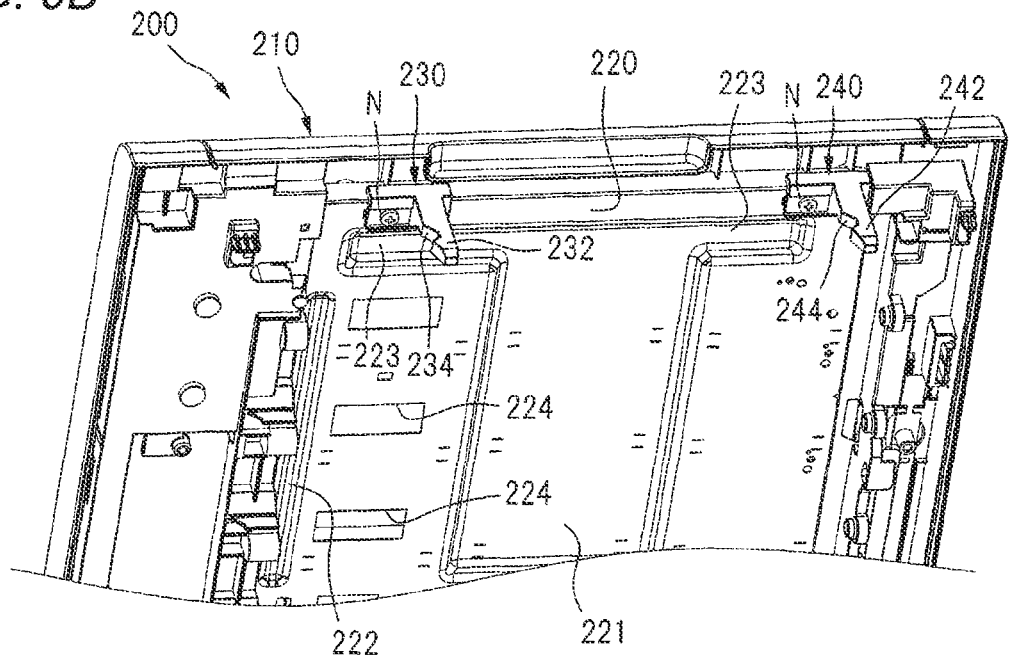

As shown in FIGS. 6A and 6B, the first engaging member 230 and the second engaging member 240 are resin members that are separately formed from the cover body 210 and are configured to be engaged with lock members 110, 120 (which will be described later) provided to the body frame 100 when the top cover 200 is located at the close position (refer to FIG. 7). The engaging members 230, 240 are provided at a front end portion of the cover body 210, which is an opposite end portion to the rotation axis 102, and are fixed to the cover body 210 via the reinforcement plate 220 with being arranged side by side at a predetermined interval in the left-right direction (axial direction). More specifically, the respective engaging members 230, 240 include base parts 231, 241 having a substantial plate shape and extension pieces 232, 242 extending from the base parts toward the front side of FIG. 6.

The base parts 231, 241 are formed with through-holes 233, 243. Screws N are screwed into the cover body 210 through the through-holes 233, 243 and through-holes 226 formed at the reinforcement plate 220, so that the respective engaging members 230, 240 are fixed to the cover body 210 via the reinforcement plate 220. Further, left side portions of the extension pieces 232, 242 are formed with engaging recess portions 234, 244. When the top cover 200 is located at the close position, the lock members 110, 120 are engaged with the engaging recess portions 234, 244, so that the top cover 200 is locked at the close position.

Figure 7:
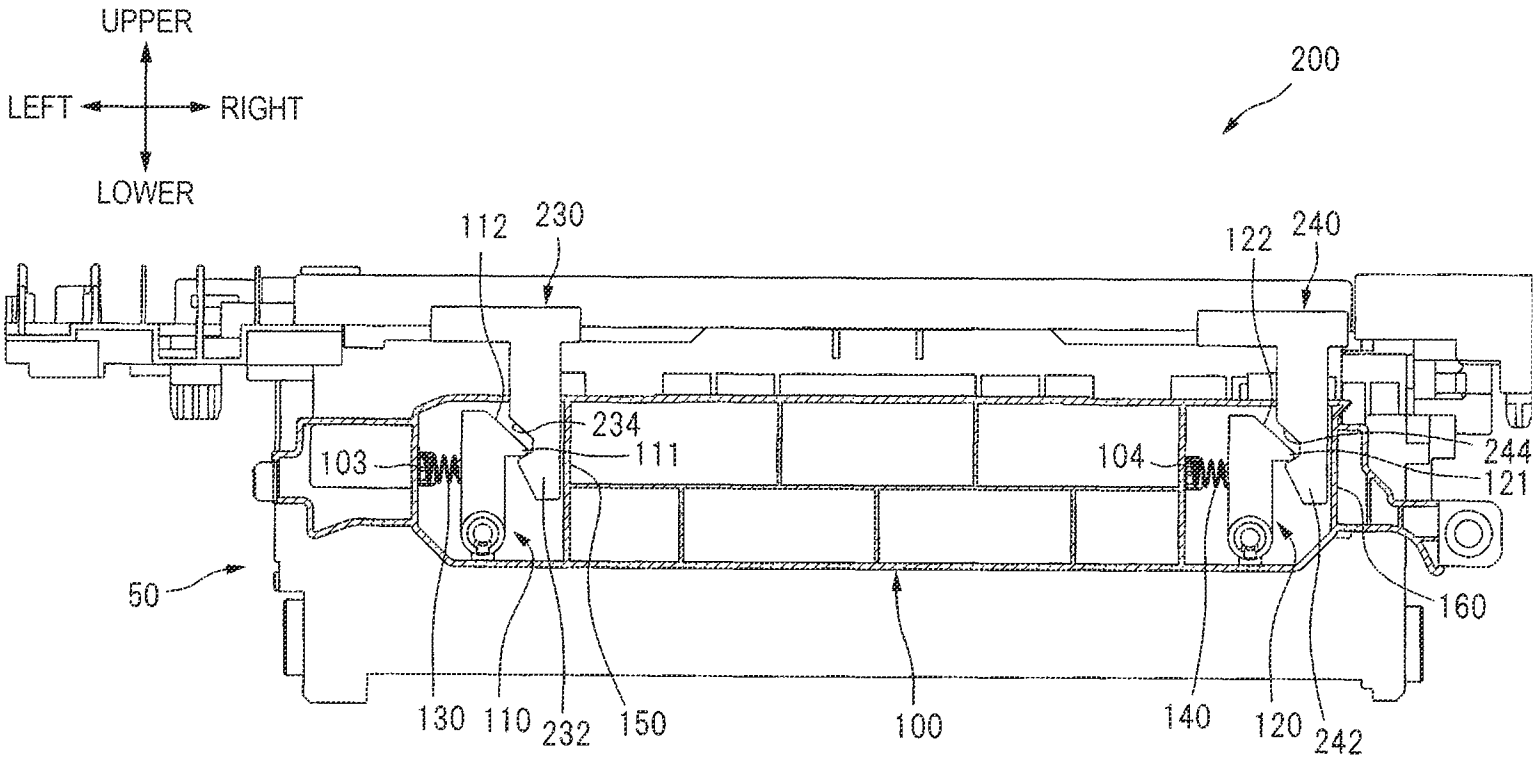
FIG. 7 is a sectional view taken along a line VII-VII of FIG. 3.

As shown in FIG. 7, the body frame 100 includes the first lock member 110, the second lock member 120, a first coil spring 130 that is an example of the first urging member and a second coil spring 140 that is an example of the second urging member.

The first lock member 110 and the second lock member 120 are rotatably supported to the body frame 100 at lower ends thereof, so that upper ends thereof can swing (move) in the front-rear direction. The first lock member 110 and the second lock member 120 are provided at upper parts thereof with engaging convex portions 111, 121 having a shape that protrudes rightwards and tapers upwards. When the top cover 200 is located at the close position, the engaging convex portion 111 is engaged with the engaging recess portion 234 of the first engaging member 230, and the engaging convex portion 121 is engaged with the engaging recess portion 244 of the second engaging member 240.

The first coil spring 130 is disposed between the first lock member 110 and a first spring attaching part 103 of the body frame 100, which is provided at the left of the first lock member 110, and is configured to urge the first lock member 110 toward the right direction (one side of the axial direction). Further, the second coil spring 140 is disposed between the second lock member 120 and a second spring attaching part 104 of the body frame 100, which is provided at the left of the second lock member 120, and is configured to urge the second lock member 120 toward the same right direction as the first coil spring 130.

When the top cover 200 is being closed from the open position, the engaging members 230, 240 abut on inclined surfaces 112, 122 of the lock members 110, 120 to thus press the inclined surfaces 112, 122. Thereby, the lock members 110, 120 swing in the left direction against the urging force of the coil springs 130, 140. Then, when the engaging recess portions 234, 244 of the engaging members 230, 240 face the engaging convex portions 111, 121 of the lock members 110, 120, the lock members 110, 120 swing in the right direction by the urging force of the coil springs 130, 140 and the engaging convex portions 111, 121 are engaged with the engaging recess portions 234, 244. Thereby, the top cover 200 is locked at the close position.

The body frame 100 includes a first abutting part 150 (first abutting surface) having a surface shape and provided across the extension piece 232 of the first engaging member 230 from the first lock member 110. In other words, the first abutting part 150 is provided at the right of the first lock member 110 with facing the first lock member 110. Further, the body frame 100 includes a second abutting part 160 (second abutting surface) having a surface shape and provided across the extension piece 242 of the second engaging member 240 from the second lock member 120. In other words, the second abutting part 160 is provided at the right of the second lock member 120 with facing the second lock member 120.

When the top cover 200 is located at the close position, a right surface of the extension piece 232 of the first engaging member 230 is pushed by the first lock member 110 urged in the right direction by the first coil spring 130 and thus abuts on the first abutting part 150. Further, when the top cover 200 is located at the close position, a right surface of the extension piece 242 of the first engaging member 240 is pushed by the second lock member 120 urged in the right direction by the second coil spring 140 and thus abuts on the second abutting part 160.

In the below, the operational effects of the color printer 1 configured as described above will be described.

As shown in FIG. 4, the reinforcement plate 220 includes the first recess part 221, so that the reinforcement plate 220 has an unevenness shape as a whole. Hence, it is possible to improve the rigidity of the reinforcement plate 220 and the top cover 200 reinforced by the reinforcement plate 220. Specifically, in this exemplary embodiment, since the reinforcement plate 220 includes the third recess parts 223 that extend from the end portion of the first recess part 221 toward the outer sides in the left-right direction, it is possible to further improve the rigidity of the reinforcement plate 220 and the top cover 200.

Incidentally, since the reinforcement plate 220 is formed with the through-holes 224 through which the harness connecting the LED units 40 and the control substrate passes, the rigidity may be partially lowered in the vicinity of the through-holes 224. However, in this exemplary embodiment, the reinforcement plate 220 includes the second recess part 222 in the vicinity of the through-holes 224, which is formed to position the through-holes 224 between the first recess part 221 and the second recess part. Therefore, it is possible to suppress the lowering of the rigidity, thereby securing the rigidity of the top cover 200.

As shown in FIGS. 3 to 5, when the top cover 200 is located at the close position, the parts (the grips 54) of the process cartridges 50 enter the first recess part 221 of the reinforcement plate 220. In other words, when the top cover 200 is located at the close position, the first recess part 221 of the reinforcement plate 220 receives therein the parts (the grips 54) of the process cartridges 50. Hence, it is possible to suppress the color printer 1 from being enlarged, compared to a configuration where the grips 54 face a part other than the first recess part 221 of the reinforcement plate 220, for example, the lower surfaces of the body portions 220A.

Furthermore, as shown in FIGS. 6A and 6B, in this exemplary embodiment, the engaging members 230, 240 are fixed to the cover body 210 via the reinforcement plate 220. Therefore, as the engaging members 230, 240 are fixed, (at least a part of) the reinforcement plate 220 can be also fixed to the cover body 210 at the same time. Thereby, compared to a configuration where the engaging members 230, 240 and the reinforcement plate 220 are separately fixed to the cover body 210, since it is possible to reduce the number of the screws, the number of holes for screw engagement and the like, it is possible to make the reinforcement plate 220 or cover body 210 smaller. As a result, it is possible to make the color printer 1 smaller.

Incidentally, since it is possible to reduce the number of the screws, the number of holes for screw engagement and the like, it is also possible to reduce the number of parts of the color printer 1, the assembling man-hour and the like. Further, since the engaging members 230, 240 are fixed to the cover body 210 via the reinforcement plate 220, it is possible to improve the attaching rigidity of the engaging members 230, 240, compared to a configuration where the engaging members 230, 240 are directly fixed to the cover body 210. As a result, it is possible to stabilize the top cover 200 at the close position.

Further, in this exemplary embodiment, as shown in FIG. 3, the first recess part 221 is formed as one recess part, and when the top cover 200 is located at the close position, the grips 54 of the respective process cartridges 50 enter the one first recess part 221. Therefore, while securing the rigidity of the reinforcement plate 220 or top cover 200 by the first recess part 221, it is possible to simplify the configuration of the reinforcement plate 220, compared to a configuration where a plurality of first recess parts is provided into which the respective grips 54 are individually introduced. Incidentally, since the process cartridge 50 is provided with the grip 54, it is possible to improve the operability when mounting and removing the process cartridge 50.

In the color printer 1, when a fan for ventilation (not shown) that is provided on a side surface of the body frame 100 is driven to exhaust the air in the color printer 1 to the outside, the air having passed through the chargers 52 may pass between the LED units 40 and the process cartridges 50 and then flow upwards, as shown with the arrows in FIG. 3. The air having passed through the charger 52 contain ozone and the like by the corona discharge. Hence, if the air passes between the process cartridge 50 and the top cover 200 (reinforcement plate 200) and finally flows to the charger 52 of the adjacent process cartridge 50, there is a possibility that the sufficient corona discharge (charging of the photosensitive drum 51) will not be made. However, in this exemplary embodiment, since the seal members 250 are disposed between the reinforcement plate 220 and the three process cartridges 50 arranged lopsidedly toward the rear, the seal members 250 can form a part of a wall of a flow passage of the air having passed through the chargers 52. In other words, in this exemplary embodiment, since the seal members 250 can partition the flow passage of the air having passed through the respective chargers 52, the air does not keep coming and going through the gap between the reinforcement plate 220 and the process cartridges 50. According thereto, it is possible to suppress the air having passed through the chargers 52 from again flowing into the chargers 52.

Further, as shown in FIG. 7, in this exemplary embodiment, since the first lock member 110 and the second lock member 120 are urged in the same direction by the coil springs 130, 140, it is possible to adopt the same lock configuration at the left at which the first engaging member 230 is arranged and at the right at the second engaging member 240 is arranged. Thereby, for example, it is possible to share parts of the first lock member 110 and the second lock member 120 and to share parts of the first coil spring 130 and the second coil spring 140. According thereto, it is possible to reduce the cost of the color printer 1.

Further, in this exemplary embodiment, since the abutting parts 150, 160 on which the engaging members 230, 240 abut when the top cover 200 is located at the close position have the surface shape, it is possible to stably support the engaging members 230, 240. Thereby, for example, since it is possible to suppress the engaging members 230, 240 (extension pieces 232, 242), which are pushed by the lock members 110, 120, from being bent, it is possible to suppress the engaging members 230, 240 from being separated from the lock members 110, 120.

Although the exemplary embodiment of the invention has been described, the invention is not limited to the exemplary embodiment. The configurations can be appropriately changed without departing from the scope of the invention.

The configuration of the reinforcement plate 220 described in the above exemplary embodiment is just exemplary, and the invention is not limited to the configuration of the above-described exemplary embodiment. For example, in the above-described exemplary embodiment, the first recess part 221 is formed as one recess part. However, the invention is not limited thereto. For example, the first recess part may be formed as a plurality of recess parts into which the parts of the respective cartridges can be individually entered. Further, referring to FIG. 4, the first recess part 221 may include a through-hole at a bottom portion thereof (connection portion 221B). Further, the second recess part 222 may have a substantial U shape in which it is connected to the first recess part 221 so as to surround the through-holes 224, when seen from the plan view. Further, in the above-described exemplary embodiment, the reinforcement plate 220 includes the through-holes 224, 225. However, the invention is not limited thereto. For example, the reinforcement plate 220 may not be provided with the through-holes. Further, in the above-described exemplary embodiment, the third recess parts 223 extend from the front end portions of the left and right sidewalls forming the first recess part 221. However, the invention is not limited thereto. For example, the third recess parts may extend from central portions or rear end portions of the left and right sidewalls forming the first recess part 221 or from front and rear sidewalls forming the first recess part 221. Alternatively, the third recess parts may not be provided.

The configuration of the engaging members 230, 240 described in the above exemplary embodiment is just exemplary, and the invention is not limited to the configuration of the above-described exemplary embodiment. For example, in the above-described exemplary embodiment, the engaging members 230, 240 are fixed to the cover body 210 via the reinforcement member 220. However, the invention is not limited thereto. For example, the engaging members may be directly fixed to the cover body. Further, in the above-described exemplary embodiment, the engaging members 230, 240 are separately formed from the cover body 210. However, the invention is not limited thereto. For example, the engaging members may be integrally formed, as parts of the cover body.

The configuration of the lock members 110, 120 described in the above exemplary embodiment is just exemplary, and the invention is not limited to the configuration of the above-described exemplary embodiment. For example, in the above-described exemplary embodiment, the lock members 110, 120 are provided to swing in the left-right direction (axial direction). However, the invention is not limited thereto. For example, the lock members may be provided to axially slide. Further, in the above-described exemplary embodiment, the respective lock members 110, 120 are urged in the same direction by the coil springs 130, 140. However, the invention is not limited thereto. For example, the urging directions may be reverse to each other.

In the above-described exemplary embodiment, the coil springs 130, 140 have been exemplified as the urging member for urging the lock members 110, 120. However, the invention is not limited thereto. For example, the urging member may be a spring member other than the coil spring, such as a torsion spring, a plate spring and the like. Further, the urging member may be an elastically deformable member such as foamed elastic member as long as it can keep the engaged state between the lock members and the engaging members and hold the cover at the locked state.

In the above-described exemplary embodiment, the body frame 100 includes the surface-shaped abutting parts 150, 160. However, the invention is not limited thereto. For example, the abutting parts may be omitted insomuch as the engaging members have the rigidity with which the engaging members are not bent even though they are pushed by the lock members.

In the above-described exemplary embodiment, the seal members 250 form a part of the wall of the flow passage of the air having passed through the chargers 52. However, the function of the seal member 250 is not limited thereto. For example, referring to FIG. 3, in the configuration where the air introduced into the apparatus is supplied to the chargers 52 through between the LED units 40 and the process cartridges 50, the seal members 250 form a part of the wall of the flow passage of the air flowing toward the chargers 52. In this case, since the seal members 250 can partition the flow passage of the air flowing toward the respective chargers 52, the air does not keep coming and going through the gap between the reinforcement plate 220 and the process cartridges 50, so that the air is substantially uniformly supplied to the respective chargers 52. Therefore, according to the configuration described above, since the seal members 250 are arranged between the reinforcement plate 220 and the process cartridges 50, it is possible to favorably supply the air to the respective chargers 52.

In the above-described exemplary embodiment, the seal members 250 are disposed between the reinforcement plate 220 and the three process cartridges 50 arranged lopsidedly toward the rear. However, the invention is not limited thereto. For example, the seal members may be disposed between the reinforcement plate and all the process cartridges. Further, when a problem does not occur (the charger and the like are not affected) even though the air keeps coming and going between the reinforcement plate 220 of the above-described exemplary embodiment and the process cartridge 50 arranged at the most forward side, for example, the seal member therebetween may be omitted. Accordingly, referring to FIG. 3, the seal members 250 may be arranged at only two places or only one place of the four places between the reinforcement plate 220 and the process cartridges 50. Further, the seal member may not be provided. Further, in the above-described exemplary embodiment, the foamed elastic member has been exemplified as the seal member. However, the invention is not limited thereto. For example, the seal member may be a deformable film made of PET resin and the like.

In the above-described exemplary embodiment, the top cover 200 that is arranged at the upper of the body frame 100 has been exemplified as the cover. However, the invention is not limited thereto. For example, the cover may be a front cover that is arranged at a front side part of the body frame or a side cover that is arranged at a left or right side part of the body frame. Further, in the above-described exemplary embodiment, the top cover 200 (cover) is rotated relative to the body frame 100 to thus open and close the opening 101. However, the invention is not limited thereto. For example, the cover may be configured to parallel move in a direction coming close to/getting away from the body frame 100 to thereby open and close the opening or to slide relative to the body frame to thus open and close the opening.

In the above-described exemplary embodiment, the grips 54 have been exemplified as the parts of the cartridges that enter the first recess part 221 of the reinforcement plate 220 when the top cover 200 is located at the close position. However, the invention is not limited thereto. For example, the corresponding part of the cartridge may be a gear for driving the photosensitive drum or developing roller provided to the cartridge, a gear box covering the gear and the like. Further, the corresponding part of the cartridge may be a part of a housing of the cartridge having no particular function. Incidentally, if the part of the cartridge having a function, such as the grip 54, is omitted, it may cause a problem, regarding the operability and the like. However, according to the invention where the first recess part into which the part of the cartridge can be introduced is provided to the reinforcement plate, it is possible to suppress the image forming apparatus from being enlarged due to the part of the cartridge.

In the above-described exemplary embodiment, the process cartridge 50 having the photosensitive drum 51 (photosensitive member), the charger 52 and the developing device 53 has been exemplified as the cartridge. However, the invention is not limited thereto. For example, the cartridge may be the developing deice 53 (so-called developing cartridge) that can be attached and detached to and from the cartridge of the above-described exemplary embodiment or a toner cartridge in which the toner is accommodated.

In the above-described exemplary embodiment, the exposure unit (LED units 40) including the LEDs as the plurality of blinking parts has been exemplified. However, the invention is not limited thereto. For example, the exposure unit may have a configuration where it includes EL elements, fluorescent members and the like as the plurality of blinking parts. Further, when configuring the plurality of blinking parts, only one light emitting device may be provided. Specifically, for example, the exposure unit may have a configuration where an optical shutter such as liquid crystal element and PLZT element is arranged at an emission side of a backlight such as fluorescent lamp.

In the above-described exemplary embodiment, the color printer 1 having the four process cartridges 50 (the plurality of cartridges) has been exemplified as the image forming apparatus. However, the invention is not limited thereto. For example, a printer having only one cartridge may be also possible. Further, in the above-described exemplary embodiment, the printer has been exemplified in which the photosensitive members are exposed by the exposure unit having the plurality of blinking parts. However, the invention is not limited thereto. For example, a printer in which the photosensitive members are exposed by high-speed scanning of light beams may be also possible. Further, the image forming apparatus is not limited to the printer and may be a copier, a multi-function device and the like having a document reading device such as flatbed scanner.

What is claimed is:

1. An image forming apparatus comprising:

a body frame having an opening, a cartridge being configured to be removably mounted to the body frame through the opening; and a cover configured to open and close the opening, wherein the cover comprises:

a cover body, and a metallic reinforcement plate configured to be covered with the cover body and configured to face the cartridge mounted to the body frame when the cover is closed, wherein the reinforcement plate comprises a first recess part recessed in a direction toward the cover body and configured to receive therein a part of the cartridge mounted to the body frame when the cover is closed.

2. The image forming apparatus according to claim 1, further comprising:

a plurality of the cartridges, wherein the first recess part is formed as one recess part configured to receive therein parts of the respective cartridges mounted to the body frame when the cover is closed.

3. The image forming apparatus according to claim 1, wherein the part of the cartridge is a grip configured to be grasped when mounting and removing the cartridge to and from the body frame.

4. The image forming apparatus according to claim 1, wherein the reinforcement plate comprises:

a through-hole that is formed at a position different from the first recess part; and a second recess part that is separately formed from the first recess part in a vicinity of the through-hole.

5. The image forming apparatus according to claim 1, further comprising:

a charger configured to charge a photosensitive member by a corona discharge; and a seal member configured to be disposed between the reinforcement plate and the cartridge when the cover is closed so as to be brought into contact with both the reinforcement plate and the cartridge.

6. The image forming apparatus according to claim 1, wherein the reinforcement plate comprises a second recess part that extends from an end portion of the first recess part.

7. The image forming apparatus according to claim 1, wherein the cover comprises:

an engaging member that is separately formed from the cover body and is configured to be engaged with the body frame when the cover is closed, wherein the engaging member is fixed to the cover body via the reinforcement plate, and wherein the cover body is composed of a resin.

8. The image forming apparatus according to claim 7, wherein the cover is provided to the body frame so as to be rotatable around a rotation axis, the rotation axis being provided to a side of a first end portion of the cover body, wherein the engaging member comprises a first engaging member and a second engaging member, which are provided at a second end portion that is opposite to the first end portion of the cover body, and which are arranged side by side in an axial direction of the rotation axis, and wherein the body frame comprises:

a first lock member configured to move in the axial direction and configured to be engaged with the first engaging member when the cover is closed;

a second lock member configured to move in the axial direction and configured to be engaged with the second engaging member when the cover is closed;

a first urging member configured to urge the first lock member toward one side of the axial direction; and a second urging member configured to urge the second lock member in the same direction as the first urging member.

9. The image forming apparatus according to claim 8, wherein the body frame comprises:

a first abutting part having a surface shape and provided across the first engaging member from the first lock member, the first engaging member being configured to abut on the first abutting part when the cover is closed; and a second abutting part having a surface shape and provided across the second engaging member from the second lock member, the second engaging member being configured to abut on the second abutting part when the cover is closed.

10. The image forming apparatus according to claim 1, wherein the cover comprises an exposure unit having a plurality of blinking parts and configured to expose a photosensitive member.

11. An image forming apparatus comprising:

a body frame having an opening, a cartridge being configured to be removably mounted to the body frame through the opening; and a cover that is configured to rotate between a close position, at which the opening is covered, and an open position, at which the opening is exposed, around a rotation axis, the cover comprising a reinforcement plate that is configured to face the cartridge mounted to the body frame when the cover is located at the close position, wherein the reinforcement plate comprises:

a pair of body parts;

a pair of bent parts that is bent from inner end portions of the pair of body parts in an axial direction of the rotation axis toward the cover from the cartridge; and a connection part connecting the pair of bent parts, and wherein a part of the cartridge is configured to be arranged at a side of the connection part from a line, which connects the inner end portions of the pair of body parts, when the cartridge is mounted to the body frame and the cover is located at the close position.

12. The image forming apparatus according to claim 11, further comprising:

a plurality of the cartridges, and wherein a part of each cartridge is configured to be arranged at the side of the connection part from the line when the cartridges are mounted to the body frame and the cover is located at the close position.

13. The image forming apparatus according to claim 11, wherein a part of the cartridge is a grip.

14. The image forming apparatus according to claim 11, wherein the reinforcement plate comprises a pair of second bent parts, which is provided at outer sides in a facing direction of the pair of bent parts, and which is bent from the pair of body parts, and wherein the pair of second bent parts is connected by the connection part.

15. The image forming apparatus according to claim 11, wherein the cover comprises:

a resin cover body configured to cover the reinforcement plate; and an engaging member that is configured to be engaged with the body frame when the cover is located at the close position, and wherein the engaging member is fixed to the cover body via the reinforcement plate by a screw.

16. The image forming apparatus according to claim 15, wherein the rotation axis is provided to a side of a first end portion of the cover body, wherein the engaging member comprises a first engaging member and a second engaging member that are provided at a second end portion that is opposite to the first end portion of the cover body and are arranged side by side in the axial direction of the rotation axis, and wherein the body frame comprises:

a first lock member configured to move in the axial direction and configured to be engaged with the first engaging member when the cover is located at the close position;

a second lock member configured to move in the axial direction and configured to be engaged with the second engaging member when the cover is located at the close position;

a first urging member configured to urge the first lock member toward one side of the axial direction; and a second urging member configured to urge the second lock member in the same direction as the first urging member.

17. The image forming apparatus according to claim 16, wherein the body frame comprises:

a first abutting surface that is provided across the first engaging member from the first lock member and configured to abut on the first engaging member when the cover is located at the close position; and a second abutting surface that is provided across the second engaging member from the second lock member and configured to abut on the second engaging member when the cover is located at the close position.

18. The image forming apparatus according to claim 11, wherein the cover comprises an exposure unit having a plurality of blinking parts and configured to expose a photosensitive member.

19. An image forming apparatus comprising:

a body frame having an opening, a cartridge being configured to be removably mounted to the body frame through the opening; and a cover configured to open and close the opening, the cover comprising:

a metallic reinforcement plate that is configured to face the cartridge mounted to the body frame when the cover is closed;

a resin cover body configured to cover the reinforcement plate; and an engaging member that is separately formed from the cover body and is configured to be engaged with the body frame when the cover is closed, wherein the reinforcement plate comprises a first recess part configured to receive therein a part of the cartridge mounted to the body frame when the cover is closed, and wherein the engaging member is fixed to the cover body via the reinforcement plate.

20. An image forming apparatus comprising:

a body frame having an opening, a cartridge being configured to be removably mounted to the body frame through the opening; and a cover configured to open and close the opening, the cover comprising:

a metallic reinforcement plate that is configured to face the cartridge mounted to the body frame when the cover is closed, and an exposure unit having a plurality of blinking parts and configured to expose a photosensitive member, wherein the reinforcement plate comprises a first recess part configured to receive therein a part of the cartridge mounted to the body frame when the cover is closed.

* * * * *